United States Patent [19]

Shannon

[11] Patent Number: 4,497,530

[45] Date of Patent: Feb. 5, 1985

[54] ELECTRICAL CONNECTOR HAVING A COUPLING INDICATOR

[75] Inventor: Suel G. Shannon, Harrisburg, Pa.

[73] Assignee: AMP Incorporated, Harrisburg, Pa.

[21] Appl. No.: 516,625

[22] Filed: Jul. 25, 1983

[51] Int. Cl.[3] ..... H01R 13/623; H01R 3/00

[52] U.S. Cl. ..... 339/89 M; 339/113 R; 339/186 M

[58] Field of Search ..... 339/113 R, 89 R, 89 C, 339/89 M, 90 R, 90 C, 186 R, 186 M

[56] References Cited

U.S. PATENT DOCUMENTS

| | | | |
|---|---|---|---|
| 291,039 | 1/1884 | Edgell | 411/209 |
| 3,601,764 | 8/1971 | Cameron | 339/89 M |
| 3,669,472 | 6/1972 | Nadsady | 339/89 R X |
| 3,901,574 | 8/1975 | Paullus et al. | 339/90 R |
| 4,056,298 | 11/1977 | Cooper et al. | 339/90 R |
| 4,059,324 | 11/1977 | Snyder et al. | 339/89 M |
| 4,165,910 | 8/1979 | Anderson | 339/89 M |
| 4,239,315 | 12/1980 | Lacaze, Jr. | 339/89 M |
| 4,443,052 | 4/1984 | Eaby et al. . | |

*Primary Examiner*—Joseph H. McGlynn
*Assistant Examiner*—Steven C. Bishop
*Attorney, Agent, or Firm*—Anton P. Ness; Adrian J. LaRue

[57] ABSTRACT

An electrical connector comprises a connector plug part and a connector receptacle part, each part comprising a molded dielectric insert and a metal cylindrical shell within which the insert is fitted and retained. The inserts have passageways therethrough in which are secured matable electrical terminals and an integral hood which extends beyond the mating face of the receptacle insert and the shell of the receptacle part also has a hood which extends forwardly beyond the receptacle insert hood. The hood of the receptacle shell extends over the eternal surface of the plug shell when the parts are mated and threads on the external surface of the receptacle shell hood are engaged by threads provided on the internal surface of a metal coupling ring which is rotatably mounted on the plug shell by a retention spring secured onto the plug shell. A pin is mounted adjacent a projection on the coupling ring, and the pin cooperates with cam and recess sections in the form of detent sections adjacent the projection of the coupling ring to provide an audible, tactile and visible indication of a fully-mated condition of the plug and receptacle parts when the pin has been disposed in one of the recess sections.

12 Claims, 9 Drawing Figures

ELECTRICAL CONNECTOR HAVING A COUPLING INDICATOR

FIELD OF THE INVENTION

This invention relates to electrical connectors and more particularly to electrical connectors having a coupling indicator to audibly, tactilely and visibly indicate complete coupling of matable connector members.

BACKGROUND OF THE INVENTION

Complete coupling of connector members is important to make certain that the electrical contacts thereof are properly mated for optimum electrical operation, especially in areas where visual indication of fully mated connectors is impossible or difficult to discern.

U.S. Pat. No. 3,901,574 discloses an electrical connector including a plug and receptacle threadably fastened to one another by a flexible plastic coupling ring. A lug on the flexible coupling ring passes over a boss member contained within the matable threaded sections causing the coupling ring to deform so that the lug member seats in position adjacent the boss member emitting an audible sound in so doing. Such an arrangement cannot be used with metal shells housing the plug and receptacle and a metal coupling ring.

U.S. Pat. No. 4,059,324 discloses an electrical connector having a plastic coupling member freely rotatably mounted on one plastic housing member which is matably engagable with another plastic housing member. The coupling member and the other housing member are threadably connected together to connect the matable housing members and the electrical contacts therein. A projection and slot arrangement is located on the coupling member and the other housing member which, when the housing members are mated at the fully-mated condition, visually indicates such condition. This arrangement also cannot be used with metal shells and a metal coupling ring.

SUMMARY OF THE INVENTION

According to the present invention, an electrical connector comprises a connector plug part and a connector receptacle part, each part comprising a molded dielectric insert and a metal cylindrical shell within which the insert is fitted and retained. The inserts have passageways therethrough in which are secured matable electrical terminals and an integral hood which extends beyond the mating face of the receptacle insert and the shell of the receptacle part also has a hood which extends forwardly beyond the receptacle insert hood. The hood of the receptacle shell extends over the external surface of the plug shell when the parts are mated and threads on the external surface of the receptacle shell hood are engaged by threads provided on the internal surface of a metal coupling ring which is rotationally mounted on the plug shell by a retention spring secured onto the plug shell. A pin is mounted adjacent a projection on the coupling ring, and the pin cooperates with cam and recess sections in the form of detent sections adjacent an anvil section of the coupling ring to provide an audible, tactile and visible indication of a fully-mated condition of the plug and receptacle parts when the pin has been disposed in one of the recess sections.

According to an additional aspect of the present invention, insert keying members are provided on the external surface of the plug insert and on the internal surface of the hood portion of the receptacle insert so that these two inserts can be mated only when these keying members are properly aligned. Additional keying members are provided on the external surface of the plug shell and on the internal surface of the receptacle shell hood, and these additional keying members must also be aligned before the two connected parts can be mated to each other. Distinctive or unique keying for a particular connector assembly is achieved when the inserts are assembled to the shells of the two connector parts by mounting the inserts at predetermined locations with a predetermined angular relationship between the insert keying members and the shell keying members. A particular connector assembly having its own distinctive angular relationship between the keying members thereon cannot, therefore, be mated with an adjacent connector assembly having a different angular relationship between its keying members.

DETAILED DESCRIPTION OF THE PREFERRED EMBODIMENT

Figure 1:
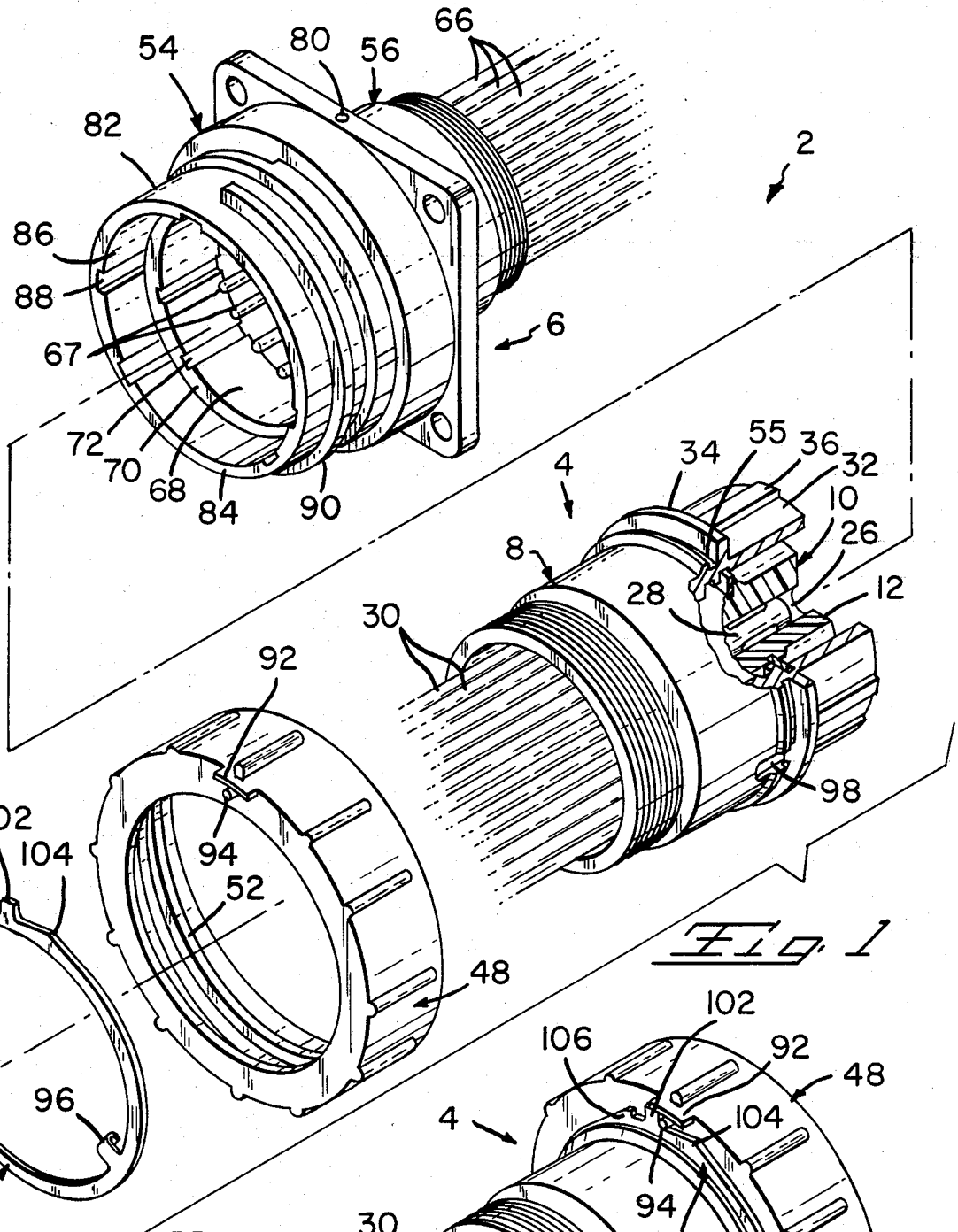
FIG. 1 is a perspective view of a connector assembly in accordance with the invention in which parts of the plug part are exploded from and in alignment with each other.

A connector assembly 2 in accordance with the invention comprises a plug part 4 and a receptacle part 6, each part containing respective electrical pin terminals 64 and receptacle terminals 28 which are electrically connected with each other when the parts are completely mated thereby electrically connecting wires 30 to wires 66.

Figure 4:
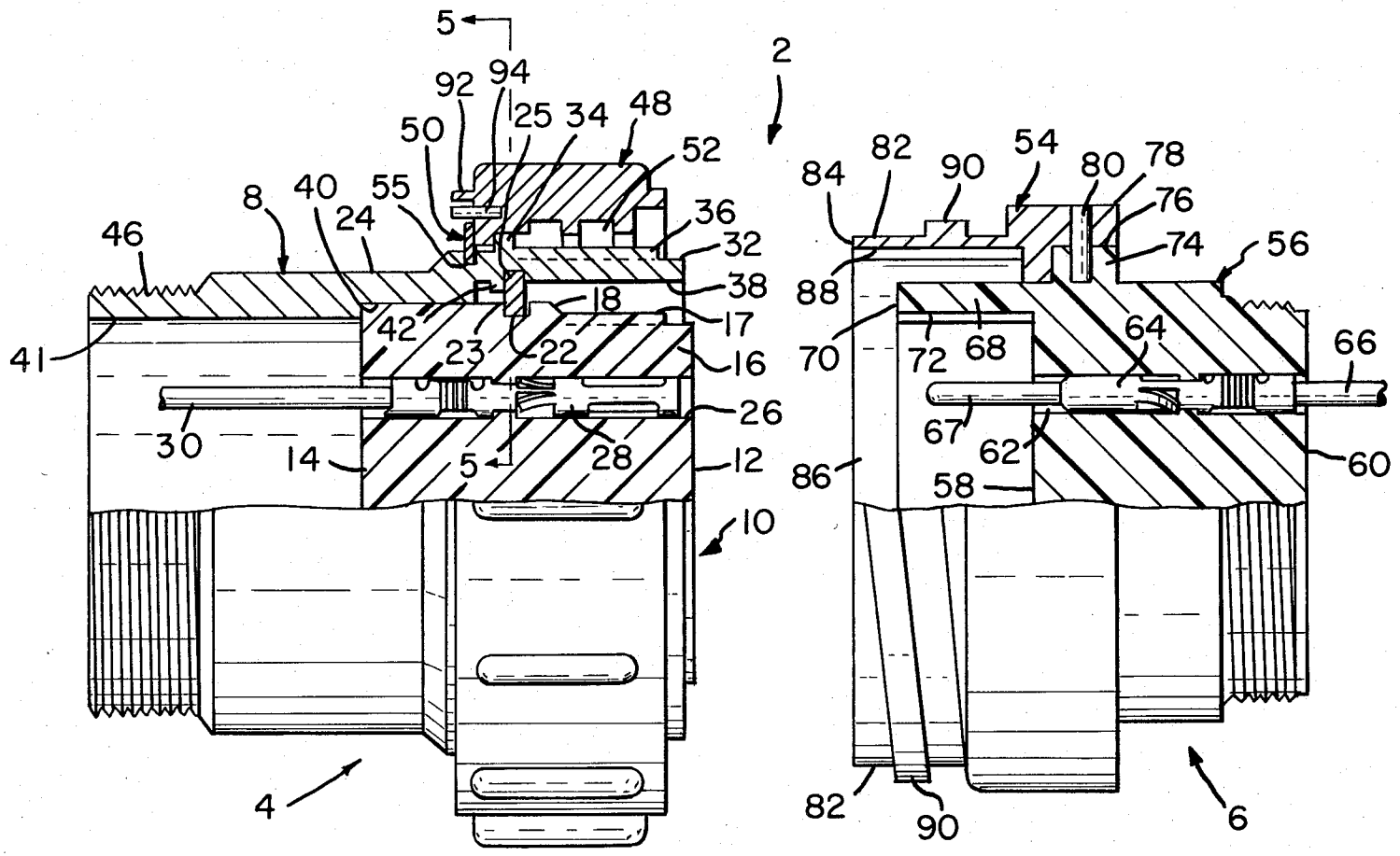
FIG. 4 is a part longitudinal section view of the plug part and the receptacle part of FIG. 2 in opposed aligned relationship.

The plug part 4 comprises a cylindrical metallic shell 8 having a plastic molded insert 10 therein. The insert 10, as shown in FIG. 4, has a forward mating surface 12, a wire entry surface 14 at its rearward end, and a cylindrical surface having keys and spaced-apart ribs thereon as described below. The forward portion 16 of the insert 10 extends from the mating surface 12 to a first circumferential rib 18 and has a plurality of axially extending key projections 17 thereon at irregularly spaced angular intervals extending from a location adjacent to the mating surface 12 to the rib 18. A second circumferential rib 20 as shown in FIG. 5 is located rearwardly of the rib 18 so that a recess 22 is formed which receives a locking ring 23 which mates with an annular recess 25 on the inside surface of a forward portion 32 of shell 8 by means of which the insert 10 is retained in the shell.

A plurality of terminal-receiving passageways 26 extend through the insert 10 from the surface 14 thereof to the mating surface 12, each passageway having a receptacle terminal 28 therein. These terminals are crimped onto wires 30 which extend rearwardly from the insert and from the shell 8.

The shell 8 as shown in FIG. 4 has a forward portion 32, an intermediate circumferential rib 34 on its external surface, and a rearward portion 24 which extends rearwardly beyond the surface 14 of insert 10. A plurality of integral keys 36 are provided on the forward portion 32 of the shell and extend from a location adjacent to the forward portion 32 of the shell 8 axially to the rib 34. The internal surface 38 of the forward portion 32 of the shell 8 is radially spaced from the surface 16 of the forward portion of the insert 10 by an amount sufficient to receive a hood 68 which is integral with the insert 56 of the receptacle part 6 as will be described below. The internal surface 40 of the portion 24 of the shell 8 is of reduced diameter than surface 38 and the rearward portion of the insert 10 is dimensioned to have a relatively close fit within portion 24 containing surface 40 of shell 8. The insert 10 is thus assembled to the shell 8 by simply moving the insert 10 into the forward portion 32 of shell 8 until the rearward portion of insert 10 is snugly seated in the reduced diameter portion 40 of shell 8 as shown in FIG. 4.

Figure 5:
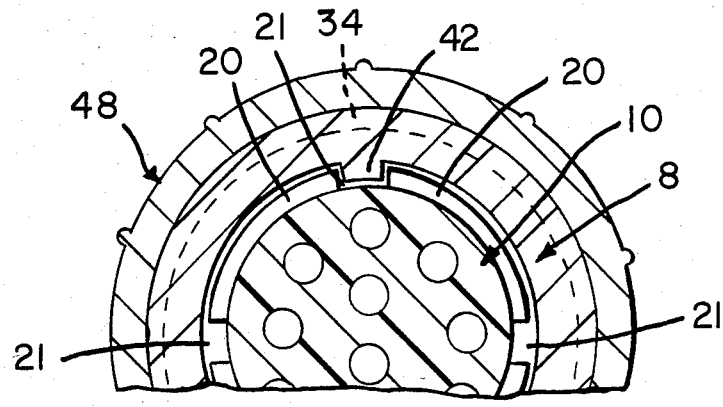
FIG. 5 is a fragmentary frontal cross-sectional view of the metallic shell of the plug part and coupling ring taken along line 5—5 of FIG. 4 showing the orientation of the insert relative to the shell.

The angular relationship of the insert 10 relative to the metallic shell 8 is determined by a locating projection 42 as shown in FIGS. 4 and 5 on the internal surface of the shell 8 and a plurality of gaps or recesses 21 in the rib 20. The insert 10 can thus be positioned in any one of several rotational positions in the shell 8 depending upon which one of the several recesses 21 is aligned with the projection 42 at the time of assembly of the insert 10 in the shell 8.

Figure 2A:
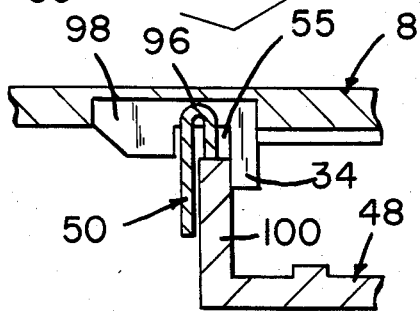
FIG. 2A is a longitudinal section view taken along line 2A—2A of FIG. 2.
Figure 2:
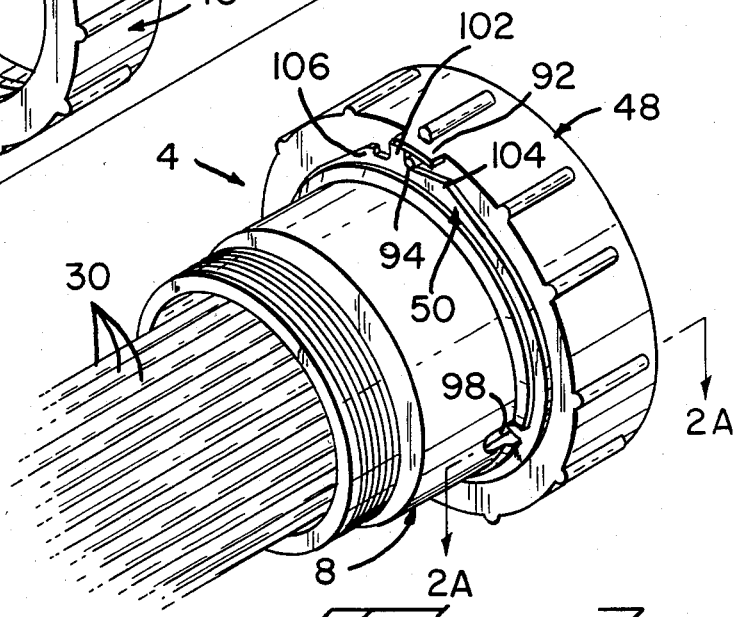
FIG. 2 is a perspective view of a plug part in an assembled condition.

A coupling ring 48 is freely and rotatably mounted on the forward portion 32 of shell 8 and retained against axial movement along shell 8 by means of an external retainer ring 50 which is received in a circumferential groove 55 in the portion 32 of shell 8. The ring 48 is retained between this ring 50 and integral rib 34 on the shell as shown in FIGS. 2, 4 and 5. The internal surface of the coupling ring 48 is provided with screw threads 52 or their equivalent for cooperation with threads 90 on the receptacle shell 54. Shells 8, 54 and coupling ring 48 are preferably formed as cast parts.

The insert 56 of the receptacle part 6 as shown in FIG. 4 has a mating surface 58, a wire entry surface 60, and a plurality of passageways 62 extending therethrough, each of which contains a pin terminal 64 crimped onto a wire 66. The pin terminals 64 have pin sections 67 which extend beyond the mating surface 58 and which are dimensioned to be received in the receptacle sections of receptacle terminals 28. The insert 56 has an integral hood 68 which surrounds and extends forwardly from the mating surface 58. The leading edge 70 of hood 68 is located beyond the ends of pin sections 67 of the pin terminals 64 and is recessed from the leading edge 84 of hood portion 82 of shell 54. The internal surface of hood 68 is provided with keyways 72 located to receive the integral key projections 17 on the plug insert 10.

A circumferential rib 74 on insert 56 as shown in FIG. 4 is received within a counterbore 76 in the rearward end of the receptacle shell 54 and insert 56 is retained in shell 54 by means of one or more pins 80 which are driven radially through shell 54 and into rib 74. The shell hood 82 has an internal surface 86 which is spaced from the external surface of the insert hood 68 and is provided with keyways 88 which are dimensioned to receive the key projections 36 on the plug shell 8.

This unique keying arrangement between the shell 8 and insert 10 and the shell 54 and insert 56 respectively is disclosed in U.S. patent application Ser. No. 235,455 filed Feb. 18, 1981, and the disclosure thereof is incorporated by reference herein.

Coupling ring 48 has an integral projection 92 below which and central thereof a hard stainless steel pin 94 is secured in coupling ring 48, the length of pin 94 being the same as the width of projection 92.

Retainer ring 50 is almost completely closed and is made from a suitable metal having the desired spring characteristics. A J-shaped section 96 as shown in FIGS. 1 and 2A extends from an inside surface of ring 50 and is disposed in a recess 98 in shell 8 which maintains ring 50 in position in groove 55 of shell 8 thereby preventing any free rotation of ring 50 relative to shell 8 as coupling ring 48 is rotated. The free end of section 96 bears against an internal surface of annular shoulder 100 of couping ring 48 which is captured between rib 34 and retainer ring 50 thereby compensating for any tolerances and enabling ring 48 to rotate smoothly.

Figure 3A:
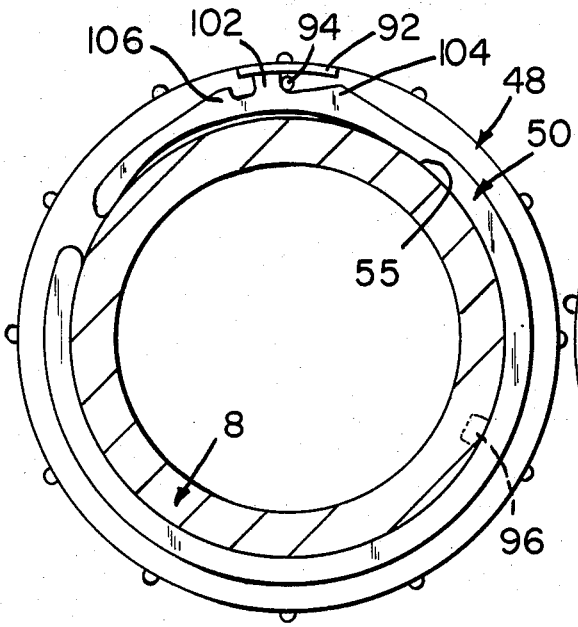
FIGS. 3A through 3D are schematic illustrations showing the operation of the coupling indicator.

Ring 50 has a hammer section 102 and detent sections 104 and 106 on each side thereof. Detent section 104 has a slightly upwardly-directed substantially linear surface extending from hammer section 102 which extends into a downwardly-directed substantially linear surface that merges into the outer radiussed surface of ring 50 as best shown in FIGS. 3A through 3D. The junction between the upwardly-directed surface and the downwardly-directed surface forms a pointed detent member. The area between hammer section 102 and the pointed detent member of detent section 104 is a relief area in which pin member 94 is disposed when coupling ring 48 is in a decoupled position. Detent section 106 has a first linear surface extending from hammer section 102 which merges into a steep inclined surface that merges into a second linear surface substantially parallel to the first linear surface which merges into a downwardly-directed linear surface. The downwardly-directed linear surface merges into the outer radiussed surface of ring 50. The second linear surface forms a flat detent member. The area between hammer section 102 and the flat detent member of detent section 106 is a relief area in which pin member 94 is disposed when coupling ring 48 is in a coupled position. The radius of the inside surface of ring 50 along detent sections 104 and 106 and hammer section 102 as shown in FIG. 3A is larger than the radius of the remainder of the inside surface of ring 50 as it extends along groove 55. The free end of ring 50 adjacent detent section 106 is radiussed for easy movement along groove 55.

Figure 3B:
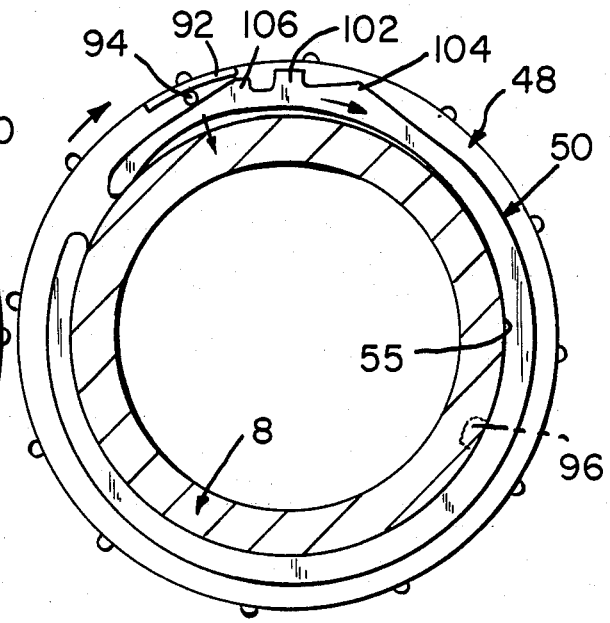
Figure 3C:
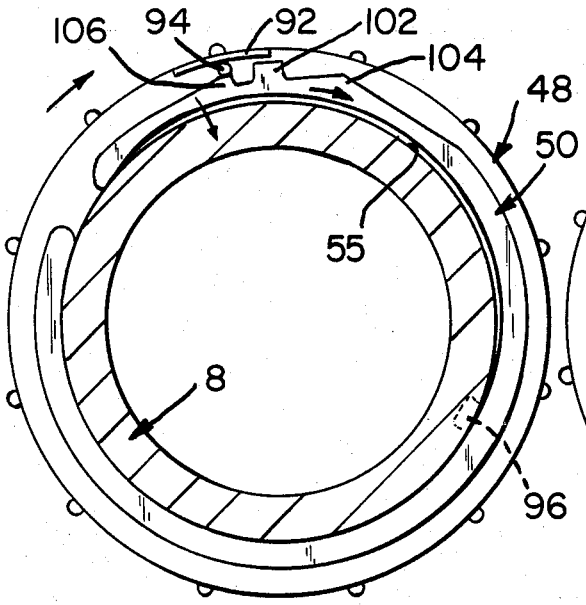
Figure 3D:
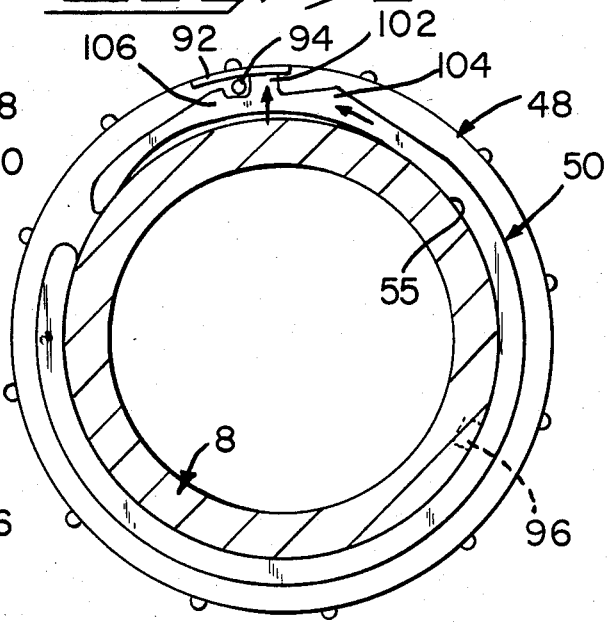

In operation as shown in FIGS. 3A through 3D with pin 94 against hammer section 102 within detent section 104 as shown in FIG. 3A indicating coupling ring 48 is in an uncoupled position, parts 4 and 6 are mated together via keys 17 and 32 mating within respective keyways 72 and 88 and threads 52 and 90 are ready for engagement. Coupling ring 48 is rotated in a clockwise direction causing anvil 92 and pin 94 to move away from hammer section 102 with pin 94 moving along detent section 104 thereby moving the larger radiussed section of ring 50 inwardly as pin 94 moves along the pointed detent member while the radiussed free end of ring 50 moves along groove 55. Threads 52 and 90 engage while coupling ring 48 is being rotated with pin member 94 moving along the outer surface of ring 50 drawing parts 4 and 6 together so that terminals 28 are matably and electrically engaged with respective terminals 64. When pin 94 moves along the downwardly-directed surface of detent section 106, parts 4 and 6 are almost completely mated and spring 50 is radially and circumferentially deformed as shown in FIG. 3B reaching maximum deformation when pin 94 moves along the second linear surface as shown in FIG. 3C. Spring 50 has now stored spring forces so that spring 50 is now in a cocked condition so that when pin 94 moves diagonally across the first linear surface after moving free of the flat detent member, the stored spring forces are released and spring 50 returns under velocity to its original position causing hammer section 102 to forcefully strike projection 92, which now acts as an anvil, and pin 94 also strikes hammer section 102 thereby resulting in a loud audible sound signifying complete mating of the connector parts as shown in FIG. 3D. The movement of pin 94 past the detent member of detent section 106 and into engagement with hammer section 102 also is a tactile indication of complete mating of the connector parts. Pin 94 between hammer section 102 and detent section 106 is also a visible indication of the connector parts being completely mated. Moreover, pin 94 in this position prevents coupling ring 48 from vibrating loose so that the connector parts remain completely mated.

More force is required to couple the connector parts than to decouple them because spring 50 is anchored in position via section 96 being disposed in recess 98 when pin 94 moves along detent section 106, whereas the radiussed free end of spring 50 moves in groove 55 when pin 94 moves along detent section 104.

When a connector assembly in accordance with the present invention is first assembled, the plug insert 10 is positioned in the plug shell 8 in a predetermined orientation relative to the plug shell 8 which is determined by the particular gap or recess 21 which is aligned with the projection 42 at the time of assembly. When the receptacle insert 56 is assembled to the receptacle shell 54, it is necessary to assemble these parts in the same relative positions as that selected for the plug insert 10 and shell 8. When the assembly is thereafter put to use, the key projections 17, 36 and keyways 72, 88 on the plug 4 and on the receptacle 6 must be respectively aligned before the coupling nut 48 can draw the plug 4 and receptacle 6 together via threads 52 and 90 of coupling ring 48 and shell 54. If an attempt is made to mate the connector parts which are not properly keyed to each other, it will be impossible to move them sufficiently close together to permit the threads 52, 90 on the coupling ring 48 and on the receptacle shell 54 to engage. It is thus impossible to mismate the parts of adjacent connector assemblies which are not specifically keyed to each other. Ring 50 in conjunction with projection 92 and pin 94 provides a tactile, audible and visible indication of the fully-mated condition of the connector parts.

I claim:

1. An electrical connector assembly of the type comprising a plug member and a receptacle member each having electrical terminals secured in passageways extending therethrough, a coupling member rotatingly mounted on the plug member and having threads on an internal surface for threadable engagement with threads on an external surface of the receptacle member to mate the plug member and receptacle member together and the electrical terminals therein, and a spring member secured onto said plug member retaining said coupling member onto said plug member, characterized in that:

said spring member has a hammer section and a detent section adjacent each other;

said coupling member has an anvil section and a pin member, said pin member rides along an outer surface of said spring member as the threads of said coupling member are threadably moving along the threads of said receptacle member and engages said detent section causing said spring member to be radially and circumferentially deformed thereby cocking said hammer section which forcefully strikes said anvil section as said pin member moves into a relief area between said hammer section and said detent section resulting in a tactile, audible and visible indication that the connector assembly is completely mated.

2. An electrical connector assembly as set forth in claim 1, characterized in that said plug member has a groove in which said spring member is disposed and a recess in which a securing section of said spring member extends thereby preventing said spring member from rotating relative to said plug member.

3. An electrical connector assembly as set forth in claim 2, characterized in that said securing section has a J-shape configuration such that a free end thereof engages an inner surface of an annular shoulder of said coupling member.

4. An electrical connector assembly as set forth in claim 1, characterized in that said spring member has another detent section adjacent said hammer section, said other detent section having another relief area in which said pin member is disposed when said coupling member is in an uncoupled position.

5. An electrical connector assembly as set forth in claim 4, characterized in that said spring member along an inside surface extending along said detent sections and said hammer section has a radius greater than the radius of the remaining inside surface thereof.

6. An electrical connector assembly as set forth in claim 1, characterized in that said plug member and said receptacle member include metal shells having dielectric inserts carrying said electrical terminals secured therein.

7. An electrical connector assembly as set forth in claim 6, characterized in that said metal shells and said inserts having mating keys and keyways to assure proper mating engagement therebetween.

8. An electrical connector assembly as set forth in claim 7, characterized in that said inserts are angularly oriented relative to said metal shells.

9. A separable electrical connector comprising:

first and second shells connectable in alignment along a common axis;

interfitting keying means on the shells to allow their axial approach and retreat relative to each other;

an insulating insert mounted within each shell;

cooperating pin and receptacle-type electrical terminals, said pin terminals mounted in one of said inserts and said receptacle terminals mounted in said other insert, said pin and terminal receptacles connectable in mated relationship; and means for connecting and disconnecting the first and second shells together, said means comprising:

a coupling ring rotatably mounted on one of said shells;

interfitting thread means in said ring and on said other shell;

a retaining ring mounted on the one of said shells retaining said coupling ring thereon; and said coupling ring having an anvil section and a pin member adjacent to said anvil section;

said retaining ring defining a spring member having a hammer section and a detent section thereto, said pin member moving along said spring member as said coupling ring is rotated causing said thread means to draw said shells, inserts and terminals together in mated relationship, and, when said pin member engages said detent section, said spring member is radially and circumferentially deformed thereby cocking said hammer section which forcefully strikes said anvil section as said pin member moves free of said detent section resulting in a tactile, audible and visible indication that the connector is completely mated.

10. A separable electrical connector as set forth in claim 9 wherein said inserts include interfitting keying means and said inserts are positionable relative to their respective shells so that said shells and their respective inserts are matably engagable.

11. A separable electrical connector as set forth in claim 9 wherein said first shell and its insert have forward sections spaced from each other defining an annular space therebetween;

said second shell and its insert have hood sections with the shell hood section covering the insert forward section and the insert hood section being disposed within said annular space when said shells and inserts are mated.

12. A separable electrical connector as set forth in claim 9 wherein said spring member includes another detent section adjacent said hammer section for indicating an uncoupled condition of the connector.

* * * * *